United States Patent [19]

Ziemba

[11] 4,033,266

[45] July 5, 1977

[54] ELECTRICAL FUZE WITH SELECTABLE MODES OF OPERATION

[75] Inventor: Richard T. Ziemba, Burlington, Vt.

[73] Assignee: General Electric Company, Burlington, Vt.

[22] Filed: June 29, 1976

[21] Appl. No.: 701,005

Related U.S. Application Data

[62] Division of Ser. No. 545,843, Jan. 31, 1975.

[52] U.S. Cl. ..... 102/70.2 R; 89/6.5

[51] Int. Cl.[2] ..... F42C 11/00; F42C 17/00

[58] Field of Search ..... 102/70.2 R; 89/6, 6.5

[56] References Cited

UNITED STATES PATENTS

| | | | |
|---|---|---|---|
| 1,791,606 | 2/1931 | Ruhlemann | 102/70.2 R |
| 1,807,708 | 6/1931 | Ruhlemann | 102/70.2 R |
| 2,545,474 | 3/1951 | Kurland et al. | 102/70.2 R |
| 2,926,610 | 3/1960 | Ruehlemann | 102/70.2 R |
| 3,043,222 | 7/1962 | Kaspaul | 102/70.2 R |
| 3,502,024 | 3/1970 | Mountjoy | 102/70.2 R |
| 3,604,356 | 9/1971 | Browning, Jr. | 102/70.2 R |
| 3,814,017 | 6/1974 | Backstein et al. | 102/70.2 R |

*Primary Examiner*—Charles T. Jordan
*Attorney, Agent, or Firm*—Bailin L. Kuch

[57] ABSTRACT

A fuze for a round of ammunition is provided wherein the gun voltage used for initiating the primer is also used to contemporaneously charge the power supply capacitor.

3 Claims, 5 Drawing Figures

FIRING CURRENT (AMPS)
FIRING TIME (MILLISECONDS)
0
1
2
3
4
5
6
50
100
150
200
250
300
350
400
86
74
10
77
59
54
26
18
42
48
52
90
92
94
100

ELECTRICAL FUZE WITH SELECTABLE MODES OF OPERATION

This application is a division of U.S. Ser. No. 545,843 filed Jan. 31, 1975.

BACKGROUND OF THE INVENTION

1. Field of the Invention

This invention relates to electrically detonated fuzes for ammunition, particularly to a fuze which may be selected during firing by the gunner to operate in any one of a plurality of modes, e.g. superquick, delayed, or self-destruct.

2. Prior Art

RC time fuzes, whose timing is varied by the charge on the capacitor are shown, for example, by G. Mountjoy in US Pat. No. 3,502,024 issued Mar. 24, 1970, and the references cited therein. It is also known to charge the capacitor at the time of firing by an electrical conductor, magnetic induction or radio wave transmission, as shown by R. H. Pintell in US Pat. No. 3,739,726 issued June 19, 1973.

None of these systems shows a convenient system for the gunner, particularly in an airplane utilizing a high rate of fire cannon, to adjust the mode of operation of the ammunition warhead fuze during firing. It is an object of this invention to provide such a system.

SUMMARY OF THE INVENTION

A feature of this invention is the use of the gun voltage for initiating the primer of a round of ammunition having a fuzed warhead to contemporaneously charge the power supply capacitor of the warhead fuze.

BRIEF DESCRIPTION OF THE INVENTION

These and other objects, features and advantages of this invention will be apparent from the following specification thereof taken in conjunction with the accompanying drawing in which.

DESCRIPTION OF THE INVENTION

Figure 1:
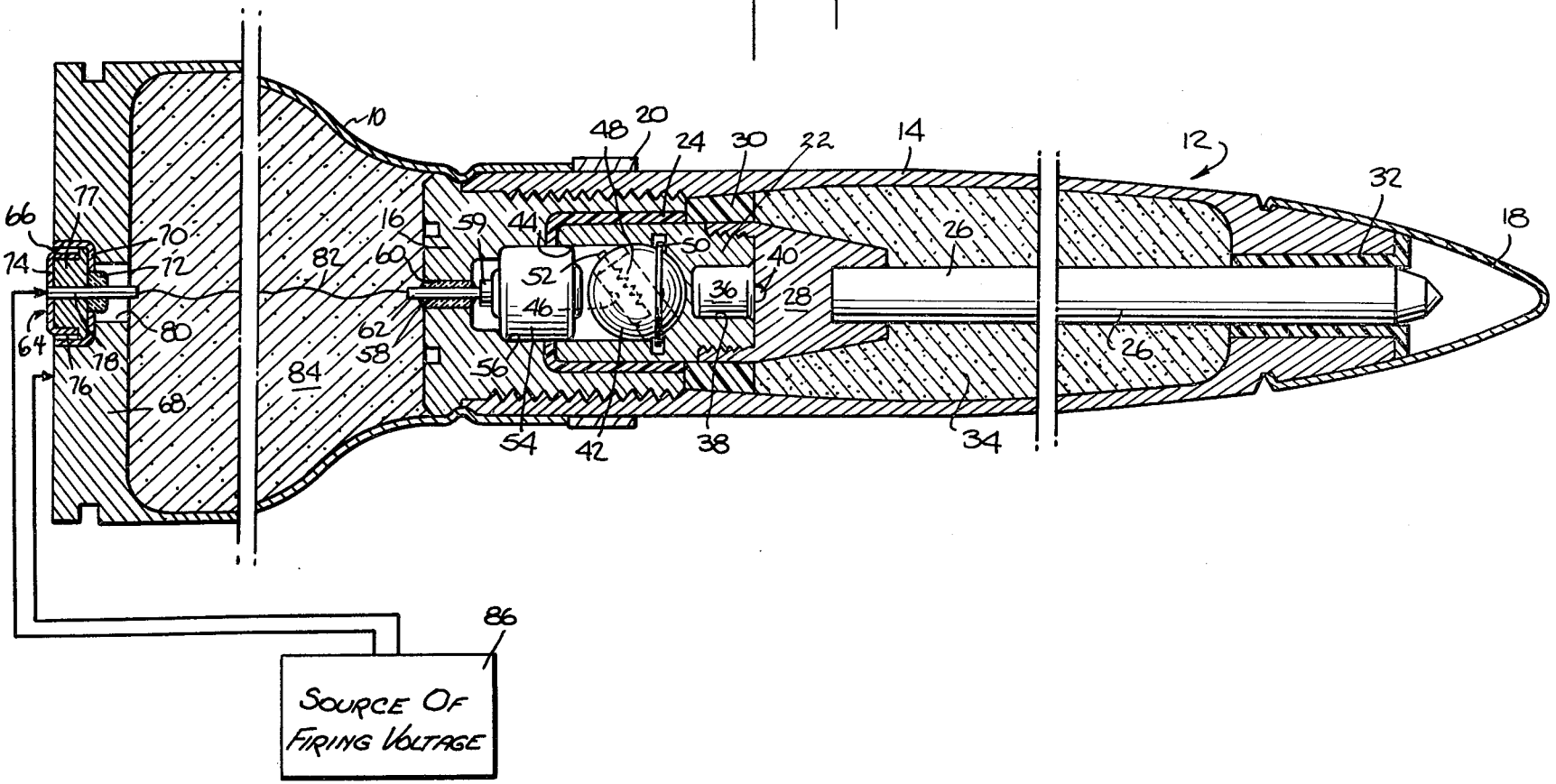
FIG. 1 shows a round of ammunition embodying a fuze of this invention.

The round of ammunition shown in FIG. 1 comprises a cartridge case 10 and a warhead 12 crimped therein. The warhead includes a metal shell 14, a metal base 16 threaded into the aft end of the shell 14, and a deformable metal windscreen 18 crimped onto the forward end of the shell. A rotating band 20 may also be fixed onto the shell. A fuze body 22 is fixed into an insulting cup 24 which is fixed into the base 16. A penetrator rod 26 has its aft end fitted into a metal support 28 which is threaded into the fuze body 22 and fitted into an insulating ring 30, and its forward end is fitted into an insulating ring 32 which is fixed into a bore in the forward end of the shell 14. The shell also encloses a quantity of high explosive powder 34. A booster charge 36 is captured in a recess 38 in the body 22 and communicates, upon detonation, through flash bores 40 with the explosive 34. A ball rotor 42, which may be of the type shown by me in U.S. Pat. No. 3,608,494, issued Sept. 28, 1971, is journalled in an aft bore 44 of the body 22. The ball rotor 42 has a diametrical bore 46 in which is fixed an electrical detonator 48. The ball is normally held in the safe, misaligned position, by a safing detent spring 50. Upon rotation of the warhead, the spring enlarges and the rotor precesses into alignment. The detonator 48 comprises a metal can having a glass bead closure at one end into which is mounted an electrical contact 52. A resistance wire is disposed within the can and is connected to and between the contact 52 and the can. The can is filled with detonating powder, and is electrically connected to the ball which is electrically connected to the body 22, which is electrically connected to the rod 26 via the support 28.

A cylindrical capacitor 54 is fixed into a bore 56 in the forward end of the base 16. A glass bead 58 is disposed in and seals a longitiudinal bore 60 communicating with the bore 56. A longtiudinal conductor 62 is fixed through the bead 58 and is in contact with a diode 59 which in turn is in contact with the aft center (positive) contact of the capacitor, whose side (negative) wall contact is in contact with the base 16. When the ball rotor is aligned, its contact 52 is in contact with the forward center (positive) contact of the capacitor.

An electrically actuated primer 64 is fixed in a bore 66 in the base 68 of the case 10. The primer comprises an outer metal cup 70 fixed into the bore 66, and having an insulator such as a glass bead 72 sealing a central hole in the cup. An inner metal cup 74 is fixed into and insulated from the outer cup by a suitable adhesive 76. Electrically conductive primer powder 77 is disposed in the volume enclosed between the cups. An electrical conductor 78 is fixed to the cup 74 and through the bead 72 and through a flash hole 80 into the internal volume of the case. A flexible conductor 82 is connected to and between the conductor 78 and the conductor 62. The internal volume of the cartridge case is filled with propellant powder 84.

It will be seen that a series electrical path is provided through the cup 74, the conductor 78, the wire 82, the conductor 62, the diode 59, the capacitor 54 the base 16, and the case 10. When firing voltage from a variable source 86 is applied to and between the cup 74 and the base 68, current flows from the cup 74, through the electrically conductive primer powder 77, to the cup 76 and then to the base 68. However, current concurrently flows in parallel from the cup 74 through the conductor 78, the wire 82, the conductor 62, the diode 59, the capacitor 54, the base 16 and then to the base 68.

The electrical characteristics of the primer are selected to require a significant increase in applied voltage to fire the case primer over and above that required to charge the fuze capacitor. The characteristics of a commericial electrical detonator, which approximate those desired, are shown in FIG. 4.

Figures 2, 3, 4, 5:
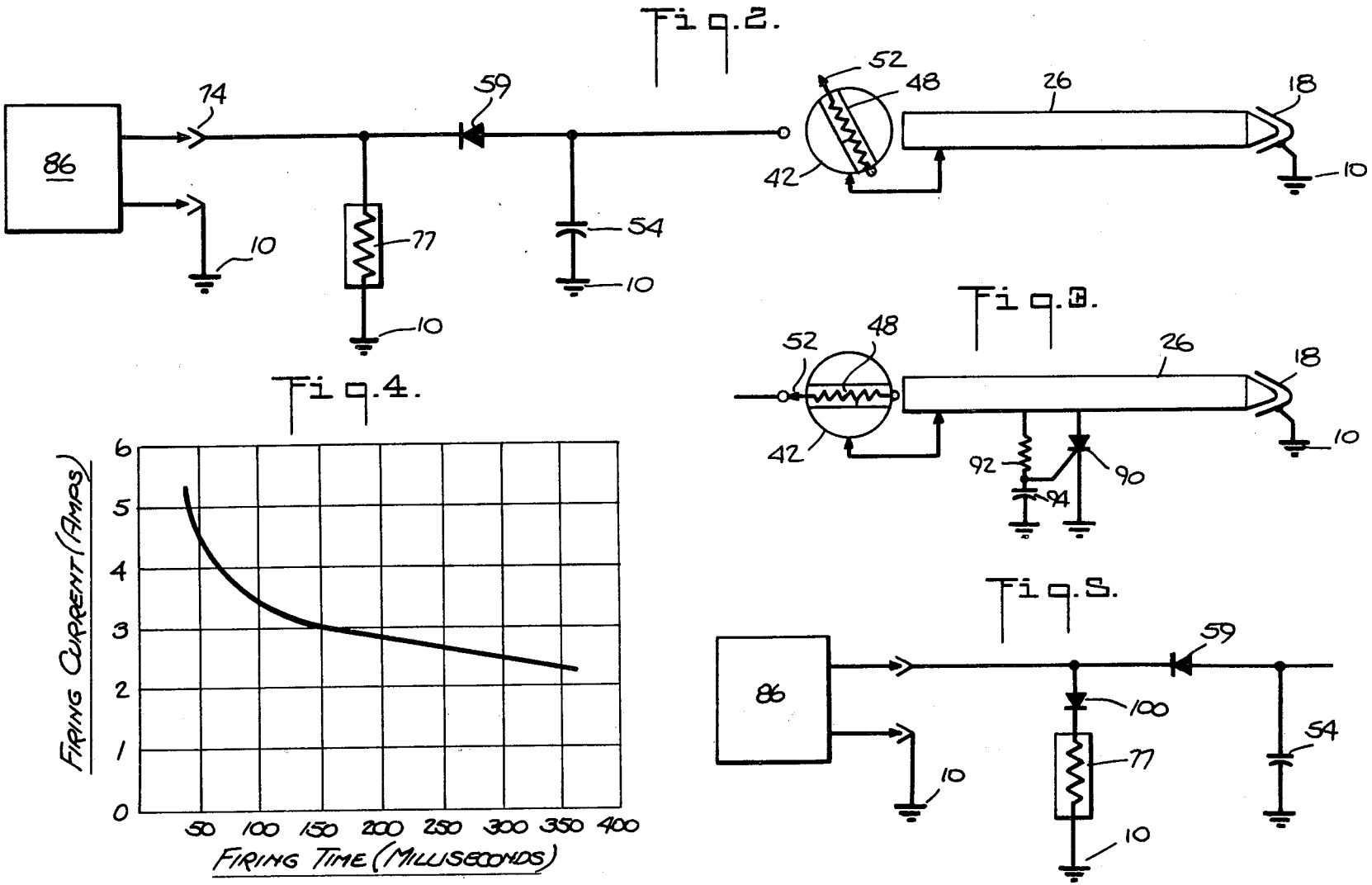
FIG. 2 shows an electrical schematic of the fuze of FIG. 1.
FIG. 3 shows an electrical schematic of a modification of the fuze of FIG. 2.
FIG. 4 shows the firing current vs response time of a detonator incorporated into the fuze of FIG. 1.
FIG. 5 shows an electrical schematic of a second modication of the fuze of FIG. 2.

The essential structure of the fuze is shown in FIG. 2. The function of the diode 59 is to preclude discharge of the capacitor 54 in the event the primer becomes short-circuited after ignition thereof. After the projectile leaves the weapon, centrifugal force developed by the spin of the projectile causes the detent spring 50 to enlarge and to release the rotor 42, which in turn precesses to the aligned position (shown schematically in FIG. 3). Upon impact, the windscreen 18 contacts the rod 26 providing an electrical discharge circuit for the capacitor 54 through the detonator 48 to thereby initiate the warhead.

The response time of the fuze can be varied from "superquick" (≃ 10μsec.) through "delayed" (≃ μsec.) by varying the initial charge on the capacitor. The initial charge is determined by the length of time the firing voltage is applied and/or the level of that voltage, the resistance of the charging circuit and the capacitance of the capacitor. Alternatively, since it is energy content which initiates the primer, the voltage may be varied in amplitude, e.g. between 75 and 200 Vdc. At any voltage level selected, the capacitor would fully charge (to that level) before the primer would function.

A "self-destruct" feature may be provided, as shown in FIG. 3, by providing an alternative path to ground for the capacitor in series with the detonator through a silicon controlled rectifier which is triggered by a RC delay in its gate circuit. The SCR 90 and its gate circuit, here shown as a resistance 92 and a capacitor 94, are conveniently located under the windscreen 18, as it is electrically in parallel with the windscreen/rod switch. The values of resistance 92 and capcitor 94 are chosen such that the SCR will fire when an adequate positive voltage is developed across the capacitor 94, and thereby at the gate of the SCR, at the desired self-destruct time.

A third embodiment of the invention, by which selection of the firing mode may be accomplished, is shown in FIG. 5. An additional diode 100 is connected in series with the primer 77, with a polarity which is the reverse of that of the diode 59. With this arrangement of diodes, the primer will only function when the source of firing voltage is of polarity opposite to that required to charge the capacitor 54. In operation, a pulse of a first polarity and adequate voltage level to charge the capacitor 54 for the desired fuze function time is first applied, and then a pulse of the opposite polarity is applied to fire the primer. This arrangement avoids a "race" condition between the capacitor charging time and the primer firing time.

It will be appreciated that if the safety feature provided by the ball rotor is not required, the detonator 48 maay be permanently connected in the circuit to capacitor 54.

What is cliamed is:

1. A method of manufacturing and operating an ordnance projectile having an impact detonated type fuze to provide a selectively variable delay in the time between impact of the projectile with a target and the detonation of said fuze, said projectile including a resistance type primer, a capacitor, a detonator, and a normally open switch which closes on impact, comprising:

providing as said detonator a resistance type detonator whose firing time increases as a function of a decrease in applied firing current;

applying a voltage concurrently and in parallel across said primer and said capacitor initially to charge said capacitor to a selectively variable voltage level which is a predetermined function of the firing current to be applied to said detonator, and subsequently to ignite said primer;

closing said switch to discharge the voltage on said capacitor across said detonator, the time interval between the closing of said switch and the combustion of said detonator being a predetermined function of the voltage level of said capacitor.

2. A method according to claim 1 further comprising:

initially providing as said primer a primer whose firing time at the highest voltage level to be applied to said primer is greater than the time initially required to charge said capacitor to the highest selectively variable voltage level.

3. A method according to claim 1 further comprising:

upon closing said normally open switch, maintaining said switch closed until combustion of said detonator occurs.

* * * * *